US008389126B2

(12) United States Patent
Kusinski et al.

(10) Patent No.: US 8,389,126 B2
(45) **Date of Patent: *Mar. 5, 2013**

(54) SURFACE TREATMENT OF AMORPHOUS COATINGS

(75) Inventors: Grzegorz Jan Kusinski, Moraga, CA (US); Jan H. Kusinski, Zielonki (PL)

(73) Assignee: Chevron U.S.A. Inc., San Ramon, CA (US)

( * ) Notice: Subject to any disclaimer, the term of this patent is extended or adjusted under 35 U.S.C. 154(b) by 221 days.

This patent is subject to a terminal disclaimer.

(21) Appl. No.: 12/769,367

(22) Filed: Apr. 28, 2010

(65) Prior Publication Data

US 2010/0279147 A1 Nov. 4, 2010

Related U.S. Application Data

(60) Provisional application No. 61/174,244, filed on Apr. 30, 2009.

(51) Int. Cl.
*B32B 15/00* (2006.01)

(52) U.S. Cl. ..... 428/547; 428/610; 428/678; 428/679; 428/682; 428/685; 428/941; 148/525; 148/403

(58) Field of Classification Search ..... None
See application file for complete search history.

(56) References Cited

U.S. PATENT DOCUMENTS

| | | | | |
|---|---|---|---|---|
| 4,568,014 | A | 2/1986 | Madsen | |
| 4,710,236 | A * | 12/1987 | Schultz | 419/33 |
| 4,711,795 | A * | 12/1987 | Takeuchi et al. | 427/130 |
| 4,772,773 | A * | 9/1988 | Hashimoto et al. | 219/121.64 |
| 4,915,980 | A * | 4/1990 | Matsunawa et al. | 427/556 |
| 4,939,041 | A | 7/1990 | Kabacoff et al. | |
| 4,964,967 | A * | 10/1990 | Hashimoto et al. | 204/292 |
| 5,112,698 | A | 5/1992 | Horvei et al. | |
| 5,989,734 | A | 11/1999 | Miura et al. | |
| 6,037,287 | A | 3/2000 | Fukubayashi | |
| 7,176,112 | B2 | 2/2007 | Lojek et al. | |
| 7,267,844 | B2 | 9/2007 | Branagan | |
| 7,323,071 | B1 | 1/2008 | Branagan | |
| 7,341,765 | B2 | 3/2008 | Branagan et al. | |
| 7,482,065 | B2 | 1/2009 | Branagan | |
| 2002/0152002 | A1 | 10/2002 | Lindemann et al. | |
| 2004/0132885 | A1 | 7/2004 | Miranda et al. | |
| 2004/0140292 | A1 * | 7/2004 | Kelley et al. | 219/76.13 |

(Continued)

FOREIGN PATENT DOCUMENTS

| | | | |
|---|---|---|---|
| EP | 2018879 | | 1/2009 |
| JP | 58-103985 | * | 6/1983 |
| JP | 2006088201 A | | 4/2006 |
| WO | WO2008/005898 | | 1/2008 |

OTHER PUBLICATIONS

Thermal Spray Metallic Coating for Offshore Platform Risers, by Juan Carlos Nava, M.E. Technical Services, Bridgeton, Missouri, Coatings & Lining Dec. 2010.

(Continued)

*Primary Examiner* — John J Zimmerman

(57) ABSTRACT

A structural component suitable for use as refinery and/or petrochemical process equipment and piping is provided. The structural component has improved corrosion, abrasion, environmental degradation resistance, and fire resistant properties with a substrate coated with a surface-treated amorphous metal layer. The surface of the structural component is surface treated with an energy source to cause a diffusion of at least a portion of the amorphous metal layer and at least a portion of the substrate, forming a diffusion layer disposed on a substrate. The diffusion layer has a negative hardness profile with the hardness increasing from the diffusion surface in contact with the substrate to the surface away from the substrate.

18 Claims, 5 Drawing Sheets

U.S. PATENT DOCUMENTS

| | | | | |
|---|---|---|---|---|
| 2004/0146739 | A1 | 7/2004 | Karhinen et al. | |
| 2004/0253381 | A1 | 12/2004 | Branagan | |
| 2006/0166020 | A1* | 7/2006 | Raybould et al. | 428/471 |
| 2007/0107810 | A1 | 5/2007 | Farmer | |
| 2007/0144621 | A1 | 6/2007 | Farmer et al. | |
| 2008/0032153 | A1 | 2/2008 | Vaughn et al. | |
| 2008/0099659 | A1 | 5/2008 | Chang et al. | |
| 2008/0196794 | A1 | 8/2008 | Blandin et al. | |
| 2008/0229700 | A1 | 9/2008 | Branagan et al. | |
| 2008/0248222 | A1 | 10/2008 | Ohara et al. | |
| 2008/0292845 | A1 | 11/2008 | Feng et al. | |
| 2009/0014096 | A1 | 1/2009 | Wiest et al. | |
| 2009/0081836 | A1 | 3/2009 | Liu et al. | |
| 2009/0178737 | A1* | 7/2009 | Masuda | 148/537 |
| 2010/0089761 | A1 | 4/2010 | Inoue et al. | |
| 2010/0279023 | A1* | 11/2010 | Kusinski et al. | 427/455 |

OTHER PUBLICATIONS

The Effect of the Thermal Spray Process on the Protective Behaviour of NiCr Alloy in Seawater, Wreijling et al., Intercom/96 online . . . , 1996.

Wear and Corrosion Resistant Amorphous / Nanostructured Steel Coatings for Replacement of Electrolytic Hard Chromium, Branagan et al., The Nanosteel Company, 2006.

Partial Crystallization Behavior of Iron Based Glasscoated Amorphous Metal by Morgan D. Conklin, 2004.

Iron-Based Bulk Metallic Glasses—Optimization of Casting, Stloukal et al., May 21, 2009, Hradec nad Moravicí.

High temperature deformation behavior of in-situ bulk metallic glass matrix composites, Fu et al., 2006.

Processing and Development of Nano-Scale HA coatings for Biomedical Application, Rabiei et al. Mater. Res. Soc. Symp. Proc. vol. 845 © 2005 Materials Research Society.

Coating by laser surface treatment, Steen et al., Journal De Physique IV, vol. 3, Dec. 1993.

Heat Treatment of Ni-P-A12O3 Electroless Coatings, Novak et al., Metal, May 21, 2009, Hradec nad Moravicí.

PCT Search Report and Written Opinion related to PCT/US2010/032788 mailed Jan. 3, 2011.

* cited by examiner

SURFACE TREATMENT OF AMORPHOUS COATINGS

CROSS-REFERENCE TO RELATED APPLICATIONS

This application claims benefit under 35 USC 119 of US Provisional Patent Application No. 61/174,244 with a filing date of Apr. 30, 2009. This application claims priority to and benefits from the foregoing, the disclosure of which is incorporated herein by reference.

TECHNICAL FIELD

The invention relates generally to surface treating of metallic surfaces for improved corrosion, wear, erosion and abrasion resistance and combination thereof.

BACKGROUND

It is known that heavy crude oils contain corrosive materials such as organic acids, carbon dioxide, hydrogen sulfide, and chlorides, etc., but seldom do they constitute a serious corrosion problem. However, a few crudes contain sufficient quantities of organic acid, generally naphthenic acids, that cause severe corrosion problems. The term naphthenic acid generally refers collectively to all of the organic acids present in crude oils. In some petrochemical applications, hydrofluoric acid (HF) is a commonly used material, e.g., it is used as a catalyst in alkylation units of refineries. In other petrochemical applications, sulfuric acid is a common corrosion problem.

In petroleum applications, materials with high Cr and Mo content are employed for their naphthenic acid corrosion resistant properties, with a minimum of 9% Cr being typically used for severe attacks (e.g., 316SS has nominally 18% Cr and 2% Mo min.). In other applications, nickel alloys are used for the handling of hydrofluoric acid.

Stating in the early 1990's, a large number of bulk metallic glasses (BMG), based mainly on Zr—, Cu—, Hf—, Fe— and other metals were developed. These materials are characterized as having excellent mechanical properties, in particular high strength and large elastic domain at room temperature, as compared to the conventional metallic alloys. Surface treatment of BMG materials is known. U.S. Patent Publication No. 2008/0041502 discloses a method for forming a hardened surface, wherein a metallic glass coating layer is heated to a temperature of 600° C. to less than the melting temperature of the alloy. The post treatment of the metallic coating is utilized to transform only the surface of the coating material, partially devitrifying the coating layer. U.S. Patent Publication No. 2004/0253381 discloses treating an amorphous metal layer, wherein the glass is put through a simple annealing. Again, only the amorphous coating layer properties are modified in the process.

There is still the need for an improved method to surface treat metallic glass coating for improved properties, which method also improves the properties of the substrate layer underlying the metallic glass coating, for coatings with improved corrosion, wear, erosion and abrasion resistance properties for petroleum-related applications. There is also a need for improved methods to treat amorphous metal (or BMG) coatings, devitrified BMG nanostructured coatings, and surface modifications in general. There is also the need for a method to improve corrosion resistant properties by surface treatment, specifically by gradually intermixing a BMG coating (or BMG-like coating) with the underlying substrate for improved corrosion, wear and abrasion resistance.

SUMMARY OF THE INVENTION

In one aspect, there is provided a component for use in handling petroleum products. The structural component comprises a metal substrate, an amorphous metal layer deposited on the substrate; a diffusion layer disposed on the metal substrate, the diffusion layer having a first surface in contact with the base substrate and a second surface opposite to the first surface, the diffusion layer having a negative hardness gradient profile, with the hardness increasing from the second surface to the first surface; and wherein the diffusion layer is formed by treating an amorphous coating layer with a sufficient amount of energy for at least a portion of the amorphous coating layer and at least a portion of the base substrate to fuse together, forming the diffusion layer. In one embodiment, the diffusion layer has a thickness of at least 5% the thickness of the amorphous metal layer.

In one aspect, a method for surface treating a structural component for use in handling petroleum products is provided. The method comprising providing a base substrate comprising metal; forming an amorphous metal layer on the base substrate; and applying a sufficient amount of energy to the amorphous metal layer to form a diffusion layer having a negative hardness gradient profile, with the hardness increasing from a first surface in contact with the base substrate to a second surface opposite to the first surface and away from the base substrate. In one embodiment, the amorphous metal layer is formed on the base substrate by depositing a molten metal alloy on the base substrate; and cooling the alloy to form the amorphous metal layer on the base substrate.

In another aspect, the method for surface treating a structural component comprises providing a base substrate comprising metal; depositing at least an amorphous metal layer on the base substrate; depositing at least a ceramic coating layer on the amorphous metal layer; and applying a sufficient amount of energy to the ceramic coating layer to cause diffusion at least a portion of the amorphous metal layer into the base substrate to form a diffusion layer having a negative hardness gradient profile, with the hardness increasing from a first surface of the diffusion layer in contact with the base substrate to a second surface opposite to the first surface.

DETAILED DESCRIPTION

Figure 1:
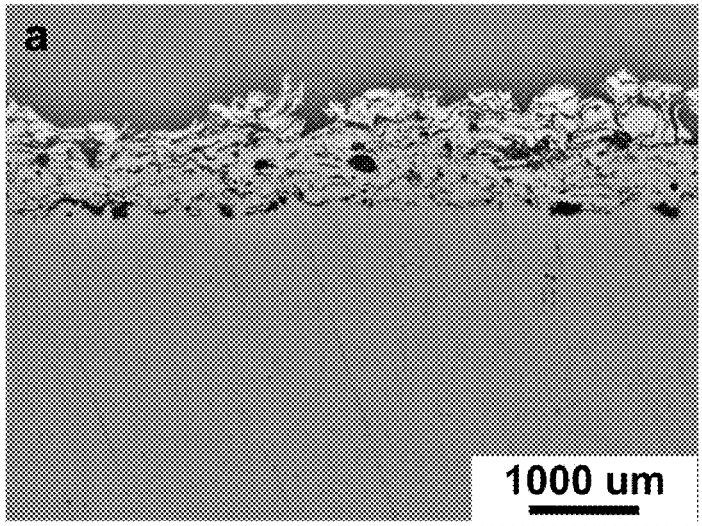
FIG. 1 shows the optical image of a cross section of a steel substrate coupon which was coated by HVOF sprayed layer of approximately 125 micrometers (um) BMG.

The following terms will be used throughout the specification and will have the following meanings unless otherwise indicated.

As used herein, the term "crude oil" refers to natural and synthetic liquid hydrocarbon products including but not limited to biodegraded oils, crude oils, refined products including gasoline, other fuels, and solvents. The term "petroleum products" refer to natural gas as well as crude oil, solid and semi-solid hydrocarbon products including but not limited to tar sand, bitumen, etc.

As used herein, the term "structural components" refer to petrochemical equipment operating at a temperature in the range of 230° C.-990° C. Some structural components are particularly susceptible to naphthenic acid corrosion if operated at temperature in the range of 230° C.-440° C., in areas of high wall shear stress (velocity), for containing crude oil products having a naphthenic acid content expressed as "total acid number" or TAN of at least 0.50. TAN is typically measured by ASTM method D-664-01 and is expressed in units of milligrams KOH/gram of oil. For the areas of aggressive naphthenic acid corrosion, temperatures of less than 450° C. are more common. However, high temperature corrosion can be locally experienced in equipment such as furnace tubes (on the flame side), or in coking unit, where coking insulates and traps heat.

As used herein, "thickness" refers to the average thickness of a layer of a material across the surface of the substrate on which the material is applied.

As used herein, the term "diffusion" refers to a process where two different metal surfaces are in contact, upon the application of sufficient energy, metal atoms from one metal surface move, infiltrate, diffuse into the surface of, or fuse with the other metal, resulting in an intermediate compound formed by this diffusion.

The amorphous coating layer in one embodiment is thermally deposited onto the substrate. As used herein, the term "thermal deposition" refers to the coating/application of the BMG in an at least partially molten state. In one embodiment, the amorphous coating layer has a strong bond strength with the underlying substrate of at least 5,000 to 10,000 psi or greater. The thermal deposition process includes, but it is not limited to, welding process, a thermal spray including arc wire, high velocity oxygen fuel (HVOF), combustion, or plasma coating, in which a molten or semi-molten material is sprayed onto the underlying substrate.

The structural component is characterized as having a base substrate coated with an amorphous metal layer, with the surface of the structural component being surface treated, forming diffusion layer providing improved corrosion, erosion, and fire resistant properties. In one embodiment, the surface is treated by application of a heat source such that sufficient intermixing of the amorphous metal layer and substrate is accomplished, providing a diffusion layer which functions as a metallurgical bonding between the amorphous metal layer and the substrate. In another embodiment, the surface treating is carried out with minimal intermixing, melting a minimal thickness of the substrate adjacent to the amorphous coating layer to minimize dilution of the coating while still providing a diffusion layer, creating a metallurgical bonding between the coating layer and the substrate. In yet another embodiment, the amorphous metal layer is completely fused/sintered, creating a diffusion layer with improved hardness, corrosion, erosion properties as well as improved bonding with the substrate.

Base Substrate:

The base substrate of the structural component can be any structural metal, including ferrous and non-ferrous materials such as aluminum, nickel, iron or steel. An example is plain-carbon steel, also referred to as "mild" steel. Other examples include but are not limited to stainless steel, low alloy steel, chromium steel, and the like.

In one embodiment, the base substrate is first cleaned free of contaminants, e.g., dirt, grease, oil, etc., before the application of the amorphous coating layer. In one embodiment, the base substrate is ultrasonically cleaned. In another embodiment and depending on the coating technique, no prior cleaning is required as a moderate layer of oxide may help in the absorption of the laser beam to speed up the coating process. In another embodiment, the substrate is cleaned by shot peening, laser shot peening, shot or sand blasting, or other abrasive or mechanical method known in the art. In yet another embodiment, the substrate is chemically cleaned by pickling or etching, or combinations thereof. In a fourth embodiment, the substrate is cleaned by reductive flame method. In a fifth embodiment, the substrate is cleaned by blasting with dry ice, which later melts away and hence prevents cross contamination of the substrate with the blast media. The cleaning preparation helps provide a certain degree of surface roughness on the substrate to improve the mechanical bonding of the coating to the substrate. In one embodiment wherein the amorphous coating is applied by HVOF thermal spraying, the surface is prepared by shot pining, or shot blasting or sand blasting, or combinations thereof.

Amorphous Coating:

As used herein, the term "amorphous metal" refers to a metallic material with disordered atomic scale crystal structure. The term can sometimes be used interchangeably with "metallic glass," or "glassy metal," or "bulk metallic glass," or "BMG," or "nanocrystalline alloys" for amorphous metals having amorphous structure in thick layers of over 1 mm. As used herein, BMG may be used interchangeably with amorphous metal.

In one embodiment, the thickness of the amorphous metal coating layer ranges from 0.1 to 500 microns (μm). In a second embodiment, from 2 to 2,500 microns. In a third embodiment, the thickness ranges from 3 to 100 microns. In a fourth embodiment, less than 50 microns. In a fifth embodiment, from 2 to 100 microns. In one embodiment when a very thin coating is desirable, the coating can be deposited on small components by any of pulsed laser deposition, vacuum techniques, laser cladding, or combinations thereof.

The amorphous metal layer is applied on the substrate as a coating layer. In one embodiment, the amorphous metal is coated directly onto the metal substrate. In another embodiment, an optional intermediate ceramic layer or a composite layer is first applied onto the metal substrate before the application of the amorphous metal layer.

The amorphous material selected for the coating depends on the end-use application, e.g., naphthenic corrosion (metal alloy with Cr, Mo, W, V, Nb or Si, etc.), HF corrosion (Ni alloy), sulfuric acid corrosion, erosion protection with the incorporation of ceramic particles, etc.

The term "metal alloy" used herein means that in addition to iron, other materials (nickel, chromium, etc.) are included. In one embodiment, the metal based alloy further comprises hard particles which may be added during manufacturing (such as $W_xC_y$/Co), precipitated out from the matrix during the thermal cycle (carbides, such as for example $W_xC_y$, $Cr_xC_y$, $Ti_xC_y$, $Nb_xC_y$, $V_xC_y$ or borides or nitrides or complex carbo-nitrides or carbo-boro-nitrides), or produced during an oxidation process (such as, $Cr_xO_y$, $Al_xO_y$, $Ti_xO_y$, or other carbides or borides or carbon-nitrides or nitrides and other complex core-shell carbides or nitrides). In one embodiment, added particles may be added to the amorphous metal. Examples include but are not limited to complex carbides, oxides, borides or combinations thereof, which may include a transition metal or metalloid. In embodiments where corrosion resistance is to be maximized, the added particles are in the form of more chemically homogeneous materials without little if any grain boundary such as carbides.

In one embodiment for HF corrosion resistance, the material is a nickel based alloy. In another embodiment, the amorphous nickel based alloy can be any of the compositions: 1) Ta (10-40 atomic %), Mo (the sum of Ta and Mo being 25-50 atomic %) and Ni (the remaining); 2) Ta (10 atomic % or more but less than 24 atomic %), Cr (the sum of Ta and Cr being 25-50 atomic %) and Ni (the remaining); and 3) Ta (10-40 atomic %), Mo and Cr (the total sum of Mo, Cr and Ta being 25-50 atomic %) and Ni (the remaining). Other metals can be included in the Ni-based amorphous metal (if not present) such as W, Mo, and Cr.

In one embodiment for naphthenic acid corrosion (NAC) resistant applications, the amorphous metal is an iron based alloy, e.g., comprising at least 50% iron and at least one of chromium and/or molybdenum. In one embodiment, the amorphous metal composition comprises at least 50% iron, optionally chromium, one or more elements selected from the group consisting of boron, carbon and phosphorous, one or both of molybdenum and tungsten; and at least one member of the group consisting of Ga, Ge, Au, Zr, Hf, Nb, Ta, La, Ce, Pr, Nd, Sm, Eu, Gd, Tb, Dy, Ho, Er, Tm, Yb, Lu, N, S, and O. In a third embodiment, the amorphous metal composition comprises $(Fe_{0.8}Cr_{0.2})_{79}B_{17}W_2C_2$.

In another embodiment, the alloy for forming the amorphous metal is selected from the compositions of $(Fe_{0.85}Cr_{0.15})_{83}B_{17}$, $(Fe_{0.75}Cr_{0.2})_{83}B_{17}$, $(Fe_{0.75}Cr_{0.25})_{83}B_{17}$, $(Fe_{0.6}Co_{0.2}Cr_{0.2})_{83}B_{17}$, $(Fe_{0.6}Cr_{0.15}Mo_{0.05})_{83}B_{17}$, $(Fe_{0.8}Cr_{0.2})_{79}B_{17}C_7$, $(Fe_{0.8}Cr_{0.2})_{79}B_{17}Si_7$, $(Fe_{0.8}Cr_{0.2})_{79}B_{17}Al_4$, $(Fe_{0.8}Cr_{0.2})_{75}B_{17}Al_4C_4$, $(Fe_{0.8}Cr_{0.2})_{75}B_{17}Si_4C_4$, $(Fe_{0.8}Cr_{0.2})_{75}B_{17}Si_4Al_4$, $(Fe_{0.8}Cr_{0.2})_{71}B_{17}Si_4C_4Al_4$, $(Fe_{0.7}Co_{0.1}Cr_{0.2})_{83}B_{17}$, $(Fe_{0.8}8Cr_{0.2})_{76}B_{17}Al_7$, $(Fe_{0.8}Cr_{0.2})_{79}B_{17}W_2C_2$, $(Fe_{0.8}Cr_{0.2})_{81}B_{17}W_2$, and $(Fe_{0.8}Cr_{0.2})_{80}B_{20}$.

In yet another embodiment, the alloy for forming the amorphous metal coating is an iron or nickel based amorphous metal with a minimum of ten alloying elements, and up to twenty alloying elements. Ingredients include: Fe, Co, Ni, Mn, B, C, Cr, Mo, W, Si, Ta, Nb, Al, Zr, Ti, La, Gd, Y, O, and N. In one embodiment, B, P and C are added to promote glass forming B and P can also be added to form buffers in the near surface region during corrosive dissolution, thereby preventing hydrolysis-induced acidification that accompanies pitting and crevice corrosion. For NAC applications, Cr, Mo, W, Al and Si are added to enhance corrosion resistance. For applications with acidic environment, Ta, Mo and Nb are added to further enhance corrosion resistance. For applications where additional strength is needed, Al, Ti and Zr are added while maintaining relatively low weight. In one embodiment, Y and other rare earths are added to lower the critical cooling rate. In some embodiments, oxygen and nitrogen are added intentionally in a controlled manner to enable the formation of oxide and nitride particles in situ, which interrupt the shear banding associated with fracture of amorphous metals and thereby enhance damage tolerance.

In another embodiment for NAC applications, the amorphous metal layer further comprises amorphous metal oxides (a-$Me_{1-x}O_x$), amorphous metal carbides (a-$Me_{1-y}C_y$)), amorphous metal carbide-nitrides (a-Me(C, N))), or amorphous silicon nitrides (a-$Si_{1-z}N_z$), wherein x is from 0.3 to 0.7, y is from 0.25 to 0.9, z is from 0.3 to 0.8, and Me (metal) is mainly one of transition metals, such as Cr, Al, Ti, Zr, or other chemical elements, such as silicon (Si).

In yet another embodiment, the amorphous metal layer comprises a bulk solidifying amorphous alloy having improved corrosion resistance properties as disclosed in U.S. Patent Publication No. U.S. 2009/0014096, herein incorporated by reference in its entirety. In one embodiment, the layer comprises a Zr—Ti-based BMG that matches the corrosion resistance properties of CoCrMo, having the molecular formula:$(Zr_aTi_b)_1$-z$(Be_cX_d)_z$ wherein X is an additive material selected from the group consisting of Y, Co, Fe, Cr, Mo, Mg, Al, Hf, Ta, Nb and V; z is from 20-50 at %; the sum of c and d is equal to z and c is at least around 25 at %; and elements having an electronegativity greater than 1.9 are present only in trace amounts.

In yet another embodiment, the amorphous metal layer comprises an iron-based alloy of the formula $Fe_{78-a-b-c}C_dB_e$-$Cr_aMO_bW_c$ wherein (a+b+c)<=17, a ranges from 0 to 10, b from 2 to 8, c from 0 to 6, d from 10 to 20, and e from 3 to 10 and wherein values of a, b, c, d and e are selected so that the atomic percent of iron exceeds 59 atomic %.

In yet another embodiment, the amorphous multi-component alloy of three or more elements is characterized by a relatively deep eutectic, which signifies high glass-forming ability. Such deep eutectic is characterized by the alpha parameter, which measures the depth of the eutectic as related to the weighted liquidus temperature.

In another embodiment, the amorphous coating layer includes structural associations or units randomly packed within the alloy matrix, e.g., particles or nano-particles or clusters having a size in any of 10 to 100 angstroms; 10 to 150 nm; and 15- to 1000 nm. Examples include nanocrystals with a diameter in the range of 1 to 100 nm. In one embodiment, the particles are ceramic particles which are added to the source of amorphous metal for application onto the substrate as a spray. In one embodiment, the added particles comprise at least one of a carbide, boride, carbonitride, oxide, nitride ceramic or a mixture of these ceramics. In another embodiment, at least a metal that is capable of forming an oxide or non-oxide ceramic, e.g., silicon carbide, silicon nitride, titanium diboride, etc. upon being incorporated onto the substrate as part of the coating layer.

In one embodiment, the amorphous coating layer is further devitrified to form partially crystallized coating, with nanometric size particles within the amorphous matrix. Such precipitation of hard particles improves wear, erosion and abrasion resistance. It is further desirable to achieve a matrix of a toughness higher that of ceramic materials.

In one embodiment, the alloy material can be applied onto the substrate in the form of a powder or a slurry ("precursor material"). When applied as a powder, the powder is heated to a sufficient temperature to bond with the substrate. In one embodiment, the precursor alloy material is a powder which is mixed with a binder, then applied onto the substrate by spraying or painting. The binder can be an organic resin, or lacquer, or a water soluble binder, which is burned off in the application process. In one embodiment, a number of layers are superimposed on one another, forming one single layer.

In one embodiment, the amorphous metal layer is applied onto the underlying substrate by a spray coating technique. Spray processing can be thermal spray processing or cold spray processing. Different spray processing can be used to form the amorphous coating layer, including but not limited to flame spray, plasma spray, high velocity air spray processing, detonation gun processing, cold spray, plasma spraying, wire arc, and high velocity oxy fuel (HVOF). In one embodiment, thermal spray is applied with a molten or semi-molten metal being sprayed onto a support layer of the structural component.

Besides the high rate spray or sputter deposition technique, other deposition methods may be used to deposit the amorphous coating layer, including but not limited to laser cladding, arc melting, ion implantation, ion plating and evaporation, pulsed and non-pulsed plasma supported coating.

In one embodiment after the thermal spray application, the alloy material is cooled to form a metallic glass. The cooling rate is typically dependent on the particular composition of the molten alloy, which cooling can be accomplished by processes known in the art, including but not limited to cooling by a chill surface (e.g., melt spinning, splat quenching, etc.), or atomization (e.g., gas atomization, water atomization, etc.) In one embodiment, cooling is carried out at a rate of at least $10^3$ K/sec. In one embodiment, conventional air cooling is sufficient to achieve amorphization.

In one embodiment, the amorphous metal layer is formed as a successive build up of multiple glass layers. In another embodiment, the amorphous metal layer is formed by different cycles of heating/cooling of metallic glass layers at predetermined temperatures and controlled rates, thus developing different microstructure with optimum corrosion resistance properties, and erosion and abrasion resistance to environmental degrading mechanisms. In yet another embodiment, the amorphous metal layer is formed as a graded coating layer, with the graded coating accomplished by shifting from one amorphous metal powder to another amorphous metal powder during cold or thermal spray operations. In a fourth embodiment, the amorphous coating layer comprises a plurality of layers, a first amorphous metal layer, a second different amorphous metal layer with more alloying elements, etc. The gradient bonding results in a fused interface such that there is at least partial metallic bonding between the metallic material and the substrate.

In one embodiment of a coating layer comprising a plurality of layers (ceramic, metallic, amorphous, etc.), at least two different glass materials are co-deposited (or layered), where the materials are characterized by having different properties including melting point. During thermal surface treatment process, the treatment temperature ($T_{tr}$) is selected above the melting $T_{m1}$ of a first material ($T_{m1}<T_{tr}$) but below the melting point of a second material $T_{m2}$ ($T_{tr}<T_{m2}$). The lower melting point material can be the amorphous material (layer) adjacent to the substrate, which would more quickly melt to seal the porosity of the amorphous coating and improve its adhesion to the surface of the substrate.

Diffusion Layer

The diffusion layer is the layer generated by treating the surface of the amorphous coating layer. The diffusion layer is the layer immediate to the based substrate. In one embodiment, the diffusion layer is an intermediate layer between the amorphous coating layer and the base substrate. In another embodiment, the diffusion layer is the amorphous coating layer after treatment, which also functions as a coating layer.

In one embodiment, the surface of the amorphous coating layer is treated via the application of a sufficient amount of energy to the amorphous coating layer to cause the diffusion of material from at least one metal layer to the next, e.g., from the substrate layer into the amorphous coating layer and/or vice versa. In one embodiment, the treatment process causes a densification of the amorphous metal layer, thus causing a reduction in the porosity of the amorphous coating.

In one embodiment, the surface treatment is at a sufficiently high temperature to cause the "remelting" at least a portion of the amorphous coating layer, as well as the intermediate region below the coating layer, forming the diffusion layer by methods including but not limited to layer surface remelting. In one embodiment, at least 10% of the amorphous material is remelted. In another embodiment, at least 25% of the amorphous material is remelted. In a third embodiment, at least 50% is remelted. In a fourth embodiment, substantially all if not most of the amorphous coating material is remelted, e.g., at least 95% of the amorphous material is remelted.

In yet another embodiment and with the appropriate selection of materials for the amorphous coating layer as well as the substrate, the surface treatment is carried out at a temperature that is lower than the melting points of the amorphous metal and the substrate. At this temperature, the two layers are not melted or distorted. However, the temperature is sufficiently high enough to cause elemental diffusion from the amorphous metal layer into the base substrate, forming the diffusion layer.

In a third embodiment, the surface treatment is done at a temperature that is lower than the melting point of the amorphous metal layer, but high enough to cause the melting of the substrate metal and/or mutual diffusion of the two different metals, forming the diffusion layer.

In one embodiment, a sufficient amount of energy is applied for an intermediate layer formed by the diffusion of metal(s), for the diffusion layer to have a thickness (or depth) of at least 2% the thickness of the amorphous coating layer (prior to the application of energy). In another embodiment, just enough of energy is applied for an intermediate layer formed by the diffusion of metal(s), for the diffusion layer to have a thickness of less than 2% the thickness of the amorphous coating layer, e.g., from 0.5 to 1.5% of the thickness. In yet another embodiment, the diffusion layer is formed by the diffusion of sufficient substrate material for a thickness of at least 5% the thickness of the amorphous coating layer. In a fourth embodiment, a diffused substrate depth of at least 10% the thickness of the amorphous coating layer. In a fifth embodiment, a diffused substrate depth of less than 20% the thickness of the amorphous coating layer. In a sixth embodiment, the surface treatment results an intermediate diffusion layer caused by the mutual diffusion of both the amorphous coating layer and the substrate layer, with the diffusion layer having a thickness of less than 25% the thickness of the amorphous coating layer. In a seventh embodiment with the remelting of the amorphous coating layer, the diffusion layer has a thickness being more or less equivalent to the original thickness of the amorphous coating layer.

In one embodiment wherein the coating layer comprises a plurality of different materials/layers (wherein the layers are fused providing a diffused/gradient coating layer), e.g., a top layer comprising ceramic materials, a second layer of amorphous metal, a third layer of a different amorphous metal, then the substrate, the surface treatment may not melt/impact the top layer, wherein some of the amorphous metal layer(s) below may partially or fully melt in the surface treatment process, diffusing into the substrate metal layer below.

The surface treatment to form the diffusion layer can be a thermal or non-thermal process, with the energy required for the surface treatment be provided by means known in the art including high velocity oxygen fuel (HVOF), ultrasonic, radiation, laser melting, plasma surface treatment, induction, electron beam, or combinations thereof In one embodiment, the surface treatment is performed with a source of RF current providing a high-amplitude current. In another embodiment, the treatment is via flame plasma surface treatment. In a third embodiment, the surface treatment is via convention electrical arc cladding processes such as gas-metal-arc (GMAW), submerged arc (SAW) and transferred plasma arc (PTA). In another embodiment, a conventional vacuum furnace heat-treatment is performed.

In one embodiment, the surface treatment is via laser melting. Laser melting is known for the capacity of being carefully controlled to limit the depth of melting of the substrate and the overall heat input into the bulk material. Lasers that are useful, may be any of a variety of lasers which are capable of providing a focused or defocused beam, which can melt the amorphous coating layer and its subsurface, i.e., a certain thickness of the substrate material. Suitable laser sources include $CO_2$ laser, diode laser, fiber laser and/or Nd:YAG lasers. In one embodiment, laser melting is carried out through the use of YAG laser as it allows for precise delivery. Additionally, the YAG wavelength is more easily and efficiently absorbed by metals. In one embodiment, the scanning speed of the laser beam ranges from 100 to 1500 nm/min. In one embodiment, the laser beam has an output power ranging from 2 to 6 kW. In one embodiment, the laser beam has an output power density ranging from $10^4$ to $10^6$ W/cm$^2$ (melting of Fe based alloys). In another embodiment, the laser beam has an output power density ranging from $10^3$ to $10^4$ W/cm$^2$ (solid state heating of Fe based alloys). In yet another embodiment, the laser is capable of producing beams with a wavelength of at least 10 μm, and a power density of at least 1 kW/cm$^2$.

In one embodiment, the surface treatment is via HVOF, causing a softening of the amorphous metal alloy applied onto the base substrate, causing the amorphous metal powder to be partially or completely sintered and fused, generating the diffusion layer.

Laser melting is well suited for remote processing and automation. Laser melting is rapid, with an area of 30-60 in$^2$ can be treated using a single laser. Laser surface treatment can be performed on selected and localized regions on the structural component's surface, as well as controlled depth to the substrate region, e.g., from one micron to 2 mm. As the surface treatment extends to the interface substrate layer adjacent to the coating layer, problems of delamination and/or separation between the substrate area and the amorphous coating layer are obviated. Furthermore, by varying the parameters of the laser beam, the composition of the precursor alloying material, the selection of the underlying substrate material (the substrate layer as is, or with an additional coating layer on top of the substrate), unconventional and non-traditional alloys can be synthesized for the diffusion layer in the intermediate region between the substrate and the amorphous coating layer.

In one embodiment, a portion of the material with corrosion resistance properties such as Cr, Mo, Ni, W, Nb, Si etc. migrates from the amorphous coating layer and diffuses into the substrate region adjacent to the amorphous coating, for an intermediate diffusion layer with improved corrosion resistant properties and increased adhesion strength.

In yet another embodiment, some of the coating elements diffuse into the substrate to provide a graded chemical composition. As the composition gradiently changes from the coating composition (the top surface or the coating layer) to the chemical composition of the substrate, a chemically graded diffusion layer is formed.

Applications:

In one embodiment, the structural component having a surface treated amorphous coating layer is suitable for use in naphthenic acid corrosive environments. The surface treated coating layer is for use to protect petrochemical equipment such as heater tube outlets, furnace tubes, transfer lines, vacuum columns, column flash zones, and pumps, operating at a temperature in the range of 230° C.-440° C. and in areas of high wall shear stress (velocity), for use in the handling of crude oil products having a naphthenic acid content expressed as "total acid number" or TAN of at least 0.50. TAN is typically measured by ASTM method D-664-01 and is expressed in units of milligrams KOH/gram of oil. Crude oils with TAN below 0.5 are generally regarded as non-corrosive, between 0.5 and 1.0 as moderately corrosive, and corrosive above 3.0.

In another embodiment, the surface treated coating layer forms a protective layer for contact with a hydrofluoric acid employed in the akylation process as a carrier medium, e.g., seal surfaces for pipes and on flanges, vales, manhole covers and vapor pockets connected to process piping. In yet another embodiment, the surface treated layer provides erosion protection for equipment employed in harsh petrochemical applications such as coking units, FCC units, and the like, e.g., surface of the cyclones in the FCC units.

The structural component after being surface treated has a surface layer with greatly improved properties, i.e., being highly corrosion resistant, highly erosion and wear resistant, allowing the structural component to remain longer in service.

In one embodiment and under electron microscope, it is observed that the amorphous coating layer after surface treated is very dense (as compared to untreated coating) with almost no pores, and no continuous pore was recognized. Additionally, the amorphous coating is firmly bonded to the substrate as evidenced by a fused gradient area, i.e., the diffusion layer, between the amorphous coating layer and the substrate layer.

In one embodiment, the structural component is characterized as having a surface with the high hardness value as expected of BMG coatings, in one embodiment, of a hardness of at least 4 GPa. In a second embodiment, a hardness of at least about 6 GPa, and a third embodiment, a hardness of at least 9 GPa. The component is further characterized as having excellent bonding between the diffusion layer and the underlying substrate. In one embodiment, the adhesion bond strength is at least 5,000 psi. In a second embodiment, a bond strength of at least 7,500 psi.

In one embodiment, the surface treated structural component has a corrosion rate in 6.5 N HCl at about 90° C. in the order of μm per year. In one embodiment, no corrosion was detected even with the amorphous layer being in contact with 12 M HCl solution for a week. In yet another embodiment, the surface treated structural component shows no mass loss (below detection limit of ICP-M) in 0.6M NaCl (⅓ month).

Lastly, the structural component after being surface treated is uniquely characterized with an intermediate diffusion layer, i.e., the interface between the substrate and the BMG coating, with the diffusion layer having an average thickness of at least 2% the thickness of the amorphous coating layer. The average thickness herein means the average thickness measurements across the diffusion layer in various locations of the structural component. In one embodiment, the intermediate diffusion layer has an average thickness of at least 10% the thickness of the amorphous coating layer. In a third embodiment, the intermediate diffusion layer has an average thickness of at least 20% the thickness of the amorphous layer.

The diffusion layer has a hardness value less than the hardness value of the amorphous layer but more than that of the substrate's hardness, defining a hardness gradient. The hardness of the diffusion layer generally decreases from the surface in contact with the amorphous layer to the surface in contact the substrate that is not surface treated, i.e., defining a negative hardness gradient profile. In one embodiment, the hardness at a location at the top surface of the diffusion layer is at least 10% higher than the hardness at a location on the surface in contact with the substrate. In another embodiment, the hardness difference is at least 25%. In a third embodiment, at least 30%. In a fourth embodiment, at least 50%. In a fifth embodiment, at least 50%. In a sixth embodiment, at least 75%. Depending on the thickness of the diffusion layer, the surface treatment method, and the composition of the materials making up the amorphous coating layer, the substrate layer, and the diffusion layer, the graded change in the hardness can be a gradual change or a sharp drop. The graded change can be generally uniform across the diffusion layer, or varying from one location in the diffusion layer to the next depending on surface treatment method.

EXAMPLES

The following illustrative examples are intended to be non-limiting.

Example 1

Two high strength martensitic P91 steel (9% Cr) plates each with dimensions of 63.5 mm by 25.4 mm by 12.7 mm were used as starting substrate samples. The P91 steel substrate has hardness of 38 HRC.

Supersonic flame (HVOF) thermal spraying was used to apply an iron-based alloy powder onto the P91 steel substrate for an amorphous or bulk metallic glass (BMG) coating having thicknesses of approximately 125, 250 and 380 microns. The alloy has a nominal composition as shown in Table 1. Attempts to measure the hardness of the BMG coating layer was not quite successful, as the coating delaminated as it was pressed on.

TABLE I

| Nominal composition of the Fe-based alloy | | | | | | |
|---|---|---|---|---|---|---|
| Element | Fe | Mo | Cr | W | B | C |
| at wt. % | 57 | 12 | 8 | 3 | 11 | 9 |

Figure 2:
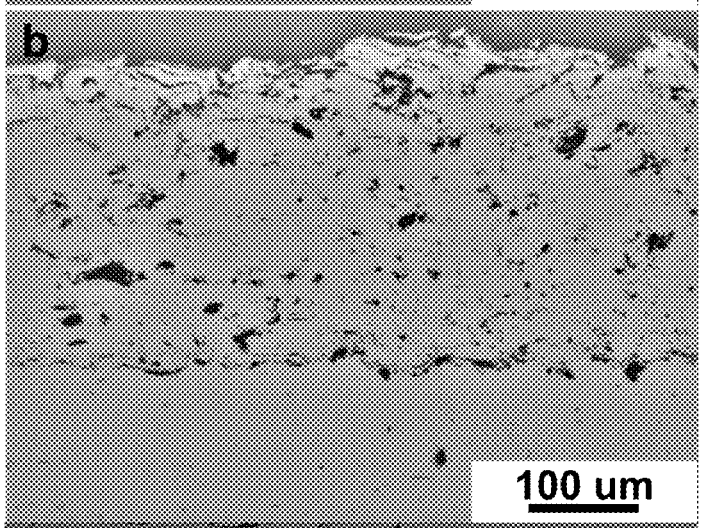
FIG. 2 is the optical image of a steel substrate coupon coated by HVOF sprayed layer of 380 microns BMG.
Figure 3:
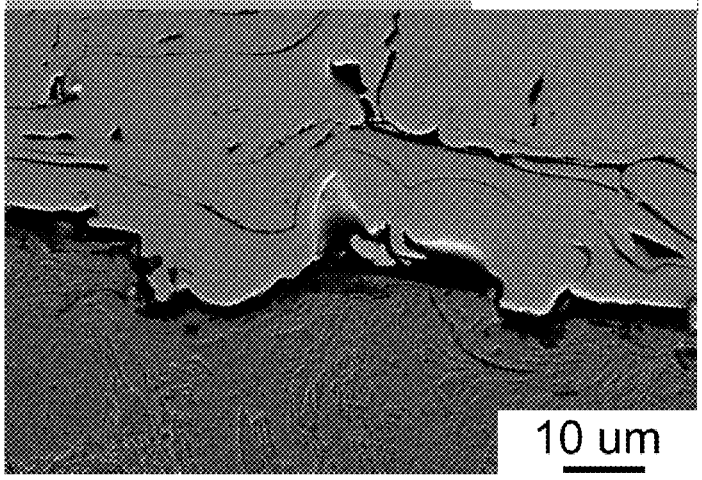
FIG. 3 shows the SEM image of the interface between the substrate and the untreated (as sprayed) HOVF BOG coating layer.
Figure 4:
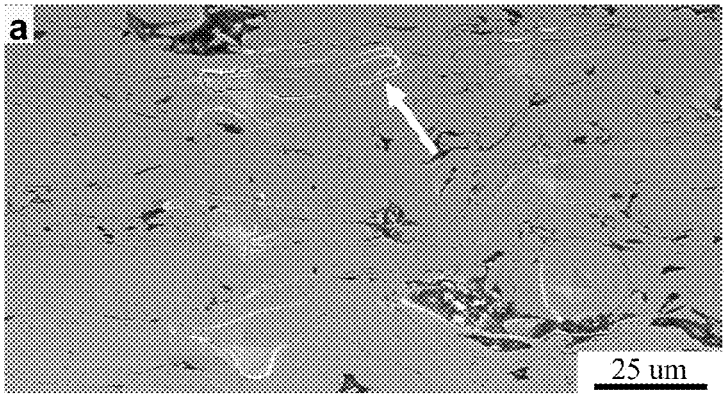
FIG. 4 is an SEM image showing the bonding between particles in the untreated (as HVOF sprayed) BOG coating layer.
Figure 5:
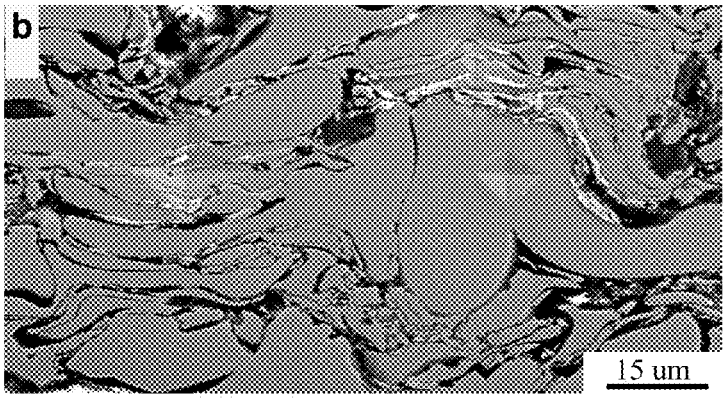
FIG. 5 is another SEM image showing the bonding between particles in the untreated (as HVOF sprayed) BOG coating layer.

FIGS. 1 and 2 show optical images of cross sections of the two thicknesses, 125 and 380 microns, respectively, with visible pores observed in the untreated BMG coating layer. FIG. 3 shows SEM image of the interface between the substrate and the untreated (not thermally sprayed) HOVF BMG coating layer, showing delamination/weak bonding between the BMG coating layer and the substrate. FIGS. 4 and 5 are SEM images confirming the weak bonding between the BMG particles with delamination clearly shown in FIG. 5.

Example 2

The BMG coated steel coupons of Example 1 were surface treated by laser melting. Laser melting was done using pulsed Nd:YAG laser (O.R. Lasertechnologie GmbH of 160 W max. power). The laser beam was focused on diameters of 2-3 mm on the sample surface at different power levels, 80, 96, and 112 W.

Figure 6:
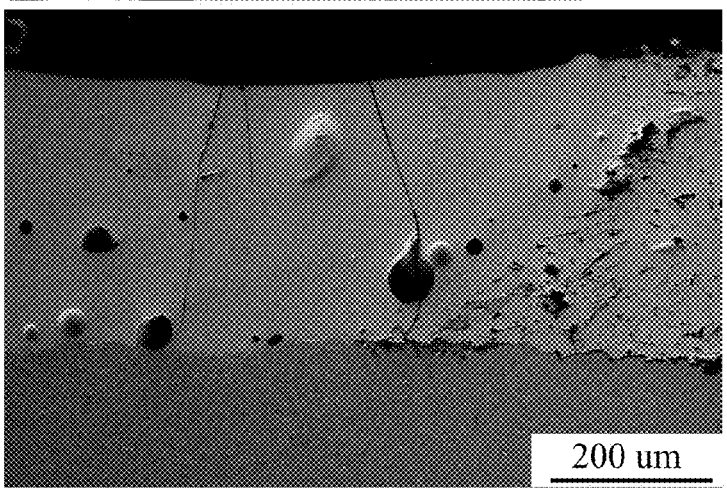
FIG. 6 is an SEM image comparing the interface diffusion layer between the substrate and the treated amorphous coating layer (laser melted area—left hand side, 96 W power) and the untreated layer (HVOF sprayed, right hand side).

FIG. 6 is a an SEM image comparing the interface between the substrate and the treated amorphous coating layer of Example 2 (laser melted area—left hand side, 96 W power) and the untreated layer (HVOF sprayed, right hand side) of Example 1, for the coupon with 380 microns thick BMG coating. The remelted (treated) area shows amorphous structure with some crystallization in some of the zones.

Figure 7:
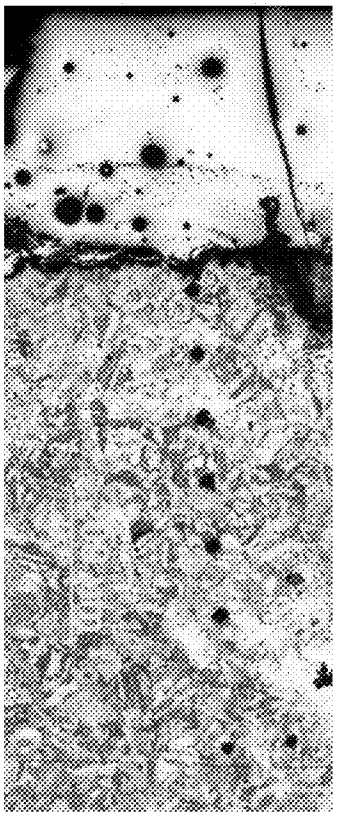
FIG. 7 is an optical image illustrating the microstructure change in the cross section of a steel substrate coupon coated with an amorphous coating layer (250 microns thick) after laser surface treatment at 80 W laser power.
Figure 8:
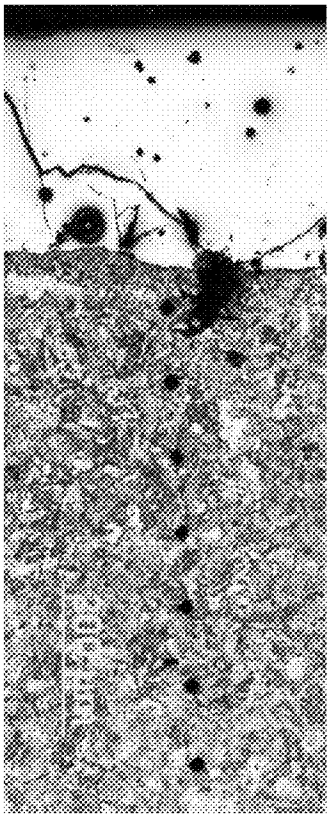
FIG. 8 is an optical image illustrating the microstructure change in the cross section of a steel substrate coupon coated with an amorphous coating layer (250 microns thick) after laser surface treatment at 96 W power.
Figure 9:
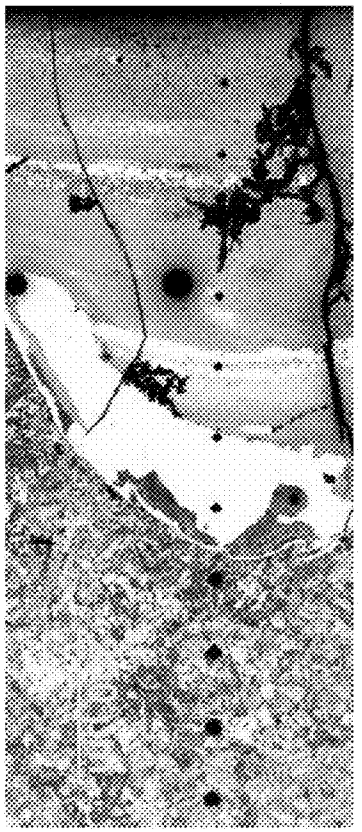
FIG. 9 is an optical image illustrating the microstructure change in the cross section of a steel substrate coupon coated with an amorphous coating layer (250 microns thick) after laser surface treatment at 112 W power.

FIGS. 7-9 are optical images showing the microstructures of the treated amorphous coating layer (380 microns thick) after laser treatment at 80 W, 96 W, and 112 W respectively. At 96 W and 112 W laser power, complete melting (treatment) of the BMG coating was achieved, as well as a certain depth of the substrate. Deep laser melting (112 W) resulted in increased amount of the substrate material in the melting zone (intermediate zone), e.g., increased amount of Fe and Cr, and reduced amount of B, C, Mo and W. The solidified zone showed crystalline and not amorphous structure. Additionally, the zone was easily etched, showing proof of crystallinity.

Figure 10:
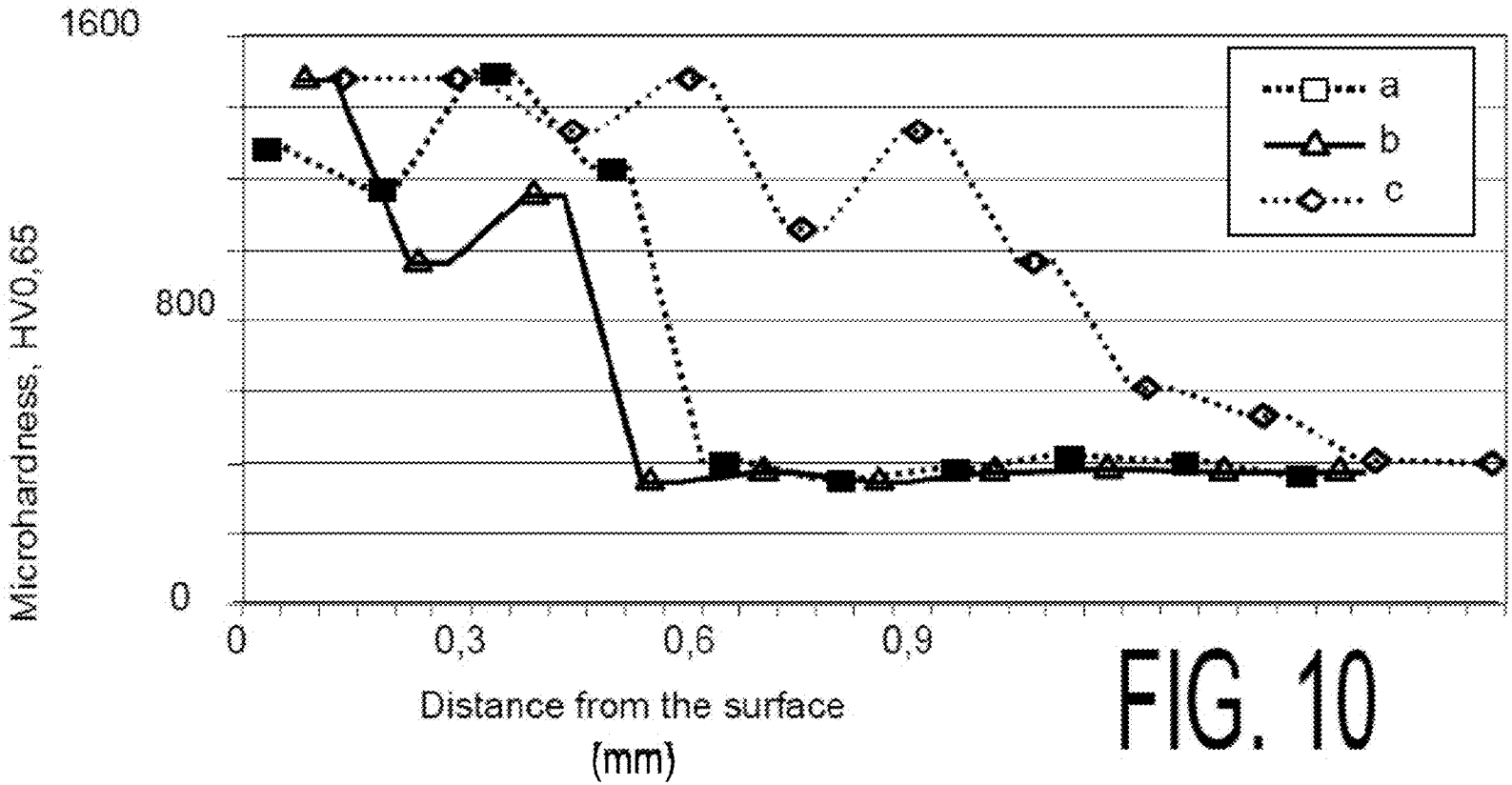
FIG. 10 is a graph illustrating the micro-hardness change as a function of distance from the surface in the 250 microns thick amorphous coating layer after laser treatment.

In FIG. 10, the microhardness (HV 0.65N) of the laser melted zone is plotted as a function of the distance from the surface of the 3 laser melted samples in FIGS. 7-10, showing a high hardness number at the surface of the amorphous coating layer (up to 1800 HV, which is over 80 HRC), and a low value for the steel substrate (36 HRC). It is noted that the intermediate area between the substrate and the treated amorphous coating layer shows a relatively high hardness value, with enrichment in chromium and iron being present on both sides of the boundary area (between substrate and laser treated BMG). EDS analysis showed that the precipitates present in the amorphous matrix near the boundary area were enriched in W and Mo.

Figure 11:
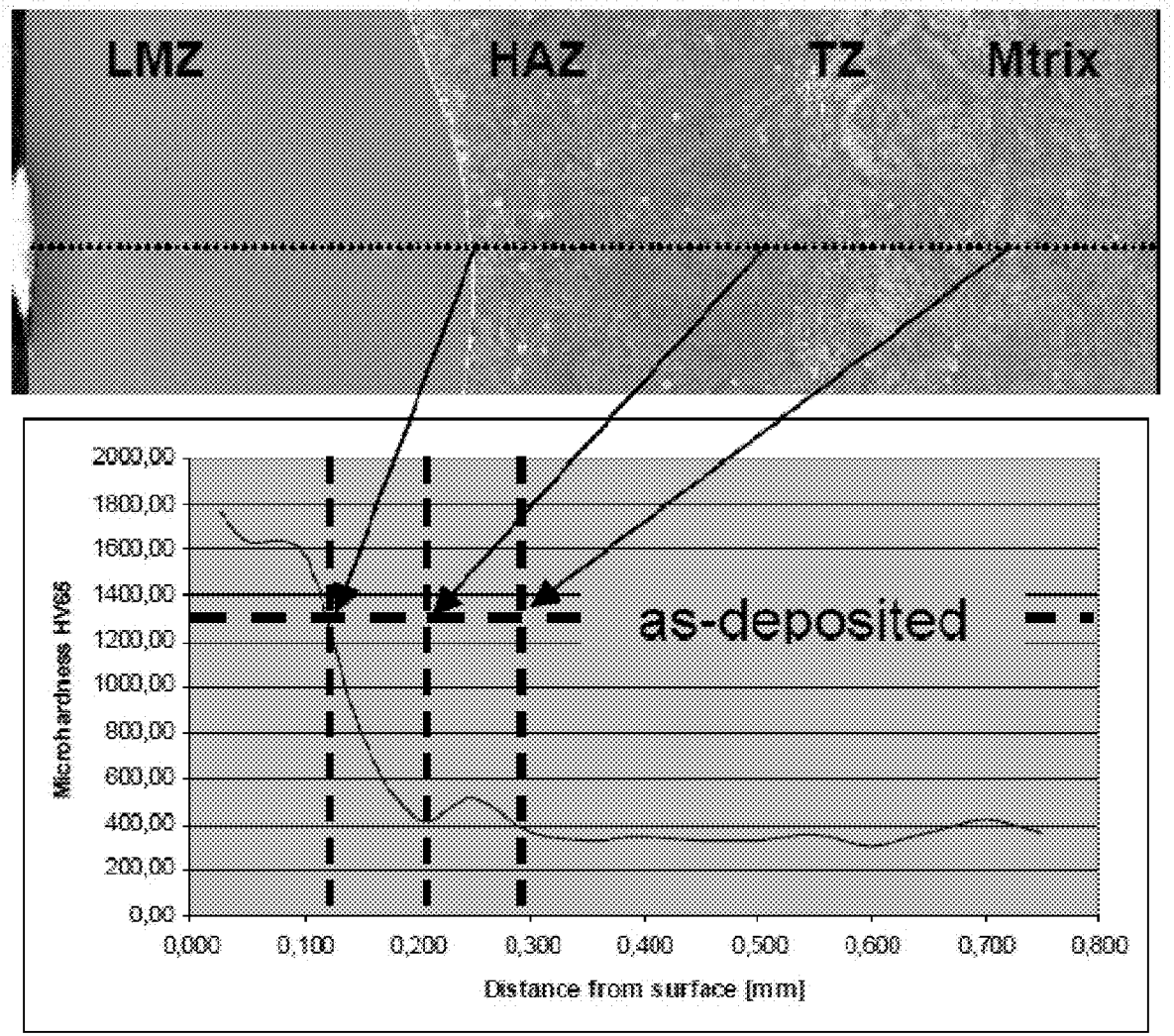
FIG. 11 is a SEM image showing the cross-section of a steel substrate coupon coated with an amorphous coating layer (125 microns thick) after laser surface treatment (80 W), and a corresponding graph illustrating micro-hardness values in the coating and the adjacent substrate.

In FIG. 11 is a SEM image of the laser treated (80W), 125 microns thick coating and the substrate along with the plot of the microhardness values in the coating and the adjacent substrate (matrix). The Figure shows an increased hardness of the laser treated coating as compared to the as-deposited coating. Also an increase of the hardness in the substrate as compared to the original value, extends over 200 microns into the substrate.

FIG. 11 is a SEM image showing the cross-section of a steel substrate coupon coated with an amorphous coating layer of 125 microns thick after laser surface treatment at 80W. The corresponding graph illustrates the corresponding microhardness values in the coating and the adjacent substrate, wherein a micro-hardness gradient is observed, with the (substrate) intermediate area shows significantly higher hardness than the hardness for the substrate itself.

Measurement Techniques:

In the examples, optical microscopy was used to obtain low magnification images using a Axio Imager MAT. M1m Zeiss microscope.

Scanning electron microscopy (SEM) micro structural examination was performed by means of HITACHI 3500N microscope operated at 15 kV. A transmission electron microscope (TEM)—HREM—G2F20 Tecnai was used to identify the microstructure in the layers. The cross-sections for TEM analysis were prepared by using FIB technique. Microhardness measurements were carried out under 0.65 N using the Hanemann indenter. Phase identification was done by X-ray diffraction (XRD) on the surface of as-sprayed and laser melted coatings using monochromatic Co $K_\alpha$ radiation ($\lambda$=0.17902 nm) with a HZG4 diffractometer operated at: U=29 kV, i=19 mA. For metallographic examinations, the as-sprayed and laser melted coatings were cut mounted in conducting resin grinded and polished using standard procedures. Examinations were performed on un-etched samples and on samples etched in 1.5 g $FeCl_3$, 5 ml HCl, 45 ml $C_2H_5OH$ regent. Energy-dispersive spectrometry (EDS Noran) analysis was employed while imaging in SEM to obtain the chemical composition in different areas of the laser melted coatings. The wear rate was determined by measuring sample weight loss, by weighting each sample before and after every 500 m of the sliding distance, up to 2000 m. The tests were carried out without any lubrication.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained by the present invention. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items.

This written description uses examples to disclose the invention, including the best mode, and also to enable any person skilled in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated by reference.

The invention claimed is:

1. A structural component, comprising:

a metal base substrate;

a chemically graded and partially crystallized coating layer disposed on the metal substrate, the chemically graded coating layer having a first surface in contact with the base substrate and a second surface opposite to the first surface, the chemically graded coating layer having and a negative hardness gradient profile, with the hardness increasing from the second surface to the first surface, wherein the chemically graded and partially crystallized coating layer has a thickness of at least 100 microns, an adhesion bond strength to the metal substrate of at least 5000 psi, and a composition gradiently changes from the second surface to the first surface; and wherein the chemically graded and partially crystallized coating layer is formed by treating an amorphous coating layer with an energy source of $10^4$ to $10^6$ W/cm$^2$ to devitrify the amorphous coating layer and for at least a portion of the amorphous coating layer and at least a portion of the base substrate to fuse together, forming the chemically graded coating layer.

2. The structural component of claim 1, wherein the chemically graded and partially crystallized coating layer is formed by treating the amorphous coating layer with a sufficient amount of energy for the at least a portion of the base substrate to diffuse and infiltrate into the amorphous coating layer, forming the chemically graded and partially crystallized coating layer, and wherein the amorphous coating layer comprises an Fe based alloy with at least 8% Cr or an Ni based alloy with at least 8% Cr.

3. The structural component of claim 1, wherein the chemically graded and partially crystallized coating layer is formed by treating the amorphous coating layer with a sufficient amount of energy for the at least a portion of the amorphous coating layer to diffuse and infiltrate into the base substrate, forming the chemically graded and partially crystallized coating layer, and wherein the amorphous coating layer comprises an Fe based alloy with at least 8% Cr or an Ni based alloy with at least 8% Cr.

4. The structural component of claim 1, wherein the chemically graded and partially crystallized coating layer is formed by treating the amorphous coating layer with a sufficient amount of energy to cause mutual diffusion with at least a portion of the amorphous coating layer to diffuse and infiltrate into the base substrate and at least a portion of the base substrate to diffuse and infiltrate into the amorphous coating layer, forming the chemically graded and partially crystallized coating layer, and wherein the amorphous coating layer comprises an Fe based alloy with at least 8% Cr or an Ni based alloy with at least 8% Cr.

5. The structural component of claim 1, wherein the chemically graded and partially crystallized coating layer is formed by treating the amorphous coating layer with a sufficient amount of energy to remelt at least a portion of the amorphous coating layer to form the chemically graded and partially crystallized coating layer, and wherein the amorphous coating layer comprises an Fe based alloy with at least 8% Cr or an Ni based alloy with at least 8% Cr.

6. The structural component of claim 1, wherein the chemically graded and partially crystallized coating layer is formed by treating the amorphous coating layer with a sufficient amount of energy to remelt substantially all of the amorphous coating layer to form the chemically graded and partially crystallized coating layer.

7. The structural component of claim 1, wherein the chemically graded and partially crystallized coating layer has a thickness of at least 150 microns.

8. The structural component of claim 1, wherein the amorphous coating layer is treated by laser treatment.

9. The structural component of claim 1, wherein the amorphous coating layer is deposited onto the base substrate by applying at least one of a nickel based alloy, an iron based alloy, and combinations thereof, onto the metal substrate, forming the amorphous coating layer upon cooling.

10. The structural component of claim 9, wherein prior to depositing the amorphous coating layer onto the substrate, the metal substrate is ultrasonically cleaned.

11. The structural component of claim 9, wherein prior to depositing the amorphous coating layer onto the substrate, the substrate is cleaned by at least one of shot peening, shot or sand blasting, pickling, etching, and combinations thereof.

12. The structural component of claim 1, wherein the metal substrate comprises a structural metal selected form ferrous and non-ferrous metals.

13. The structural component of claim 12, wherein the metal substrate comprises carbon steel.

14. The structural component of claim 1, wherein the amorphous coating layer is a nickel-based material.

15. The structural component of claim 1, wherein the amorphous layer comprises a plurality of different amorphous alloy layers, with each alloy layer being deposited by co-deposition or layering.

16. The structural component of claim 1, wherein the structural component is characterized as having a surface hardness of at least 4 GPa.

17. The structural component of claim 1, wherein the adhesion bond strength between the chemically graded and partially crystallized coating layer and the substrate is at least 5,000 psi.

18. The structural component of claim 17, wherein the adhesion bond strength between the chemically graded and partially crystallized coating layer and the substrate is at least 7,500 psi.

* * * * *